US008839708B2

(12) United States Patent
Chiappini et al.

(10) Patent No.: US 8,839,708 B2
(45) Date of Patent: Sep. 23, 2014

(54) ARMED VEHICLE WITH IMPROVED STRUCTURE

(75) Inventors: Andrea Sandro Chiappini, La Spezia (IT); Manuel D'Eusebio, La Spezia (IT)

(73) Assignee: OTO Melara S.p.A., La Spezia (IT)

( * ) Notice: Subject to any disclaimer, the term of this patent is extended or adjusted under 35 U.S.C. 154(b) by 0 days.

(21) Appl. No.: 13/328,711

(22) Filed: Dec. 16, 2011

(65) Prior Publication Data

US 2012/0180641 A1 Jul. 19, 2012

(30) Foreign Application Priority Data

Dec. 17, 2010 (IT) ..... T02010A1012

(51) Int. Cl.

| | |
|---|---|
| ***F41H 5/20*** | (2006.01) |
| ***F41A 9/00*** | (2006.01) |
| ***F41H 5/013*** | (2006.01) |
| ***F41H 7/04*** | (2006.01) |
| ***F41A 9/82*** | (2006.01) |

(52) U.S. Cl.

CPC ..... *F41H 7/04* (2013.01); *F41H 5/013* (2013.01); *F41A 9/82* (2013.01)

USPC ..... 89/36.13; 89/45

(58) Field of Classification Search

USPC ..... 89/36.01, 36.13, 36.14, 37.21, 40.01, 89/45, 46, 47

See application file for complete search history.

(56) References Cited

U.S. PATENT DOCUMENTS

| | | | | |
|---|---|---|---|---|
| 4,836,085 | A * | 6/1989 | Winkler et al. | 89/45 |
| 4,852,461 | A * | 8/1989 | von Laar et al. | 89/46 |
| 4,928,574 | A * | 5/1990 | Golden | 89/34 |
| 4,947,728 | A * | 8/1990 | Mühlhausen et al. | 89/46 |
| 5,076,138 | A * | 12/1991 | Mannhart et al. | 89/33.16 |
| 5,223,663 | A * | 6/1993 | Bender-Zanoni et al. | 89/46 |
| 5,233,125 | A * | 8/1993 | Bouver et al. | 89/36.13 |
| 5,284,082 | A * | 2/1994 | Sprafke et al. | 89/36.13 |
| 5,335,580 | A * | 8/1994 | Mouterde et al. | 89/47 |
| 5,576,508 | A * | 11/1996 | Korpi | 89/36.01 |
| 5,648,632 | A * | 7/1997 | Becker et al. | 89/41.05 |
| 6,769,344 | B2 * | 8/2004 | Domeij | 86/46 |
| 7,111,544 | B2 * | 9/2006 | Kohlstedt et al. | 89/46 |
| 7,159,504 | B2 * | 1/2007 | Heldmann et al. | 89/45 |
| 7,231,863 | B2 * | 6/2007 | Domeij | 89/46 |
| 7,475,626 | B2 * | 1/2009 | Grunewald | 89/45 |
| 8,215,225 | B1 * | 7/2012 | Zangrando et al. | 89/46 |

(Continued)

FOREIGN PATENT DOCUMENTS

| | | |
|---|---|---|
| DE | 20 19 144 | 5/1984 |
| DE | 31 21 143 | 9/1990 |
| DE | 37 41 101 | 10/1991 |
| GB | 1 040 323 | 8/1966 |

OTHER PUBLICATIONS

Italian Search Report for Italian Application No. TO 2010 A 001012 mailed Aug. 4, 2011.

*Primary Examiner* — Bret Hayes

(74) *Attorney, Agent, or Firm* — Merchant & Gould P.C.

(57) ABSTRACT

An armed vehicle (10) with improved structure includes a hull (11), which, in use, is suited to house one or more men, devices for the movement on the ground, and an armed turret (30), which is positioned on top of an upper part of the hull (11). The armed vehicle (10) includes an interface structural element (11*s*), which is cold-added; the interface structural element (11*s*) constitutes an interface element between the hull (11) and the armed turret (30).

5 Claims, 4 Drawing Sheets

(56) References Cited

U.S. PATENT DOCUMENTS

2002/0170420 A1* 11/2002 Falk ..... 89/33.16
2003/0089220 A1* 5/2003 Boudreau et al. ..... 89/1.815
2005/0252367 A1* 11/2005 Jilg et al. ..... 89/36.14
2007/0119296 A1* 5/2007 Niv et al. ..... 89/37.02
2009/0114085 A1* 5/2009 Diller et al. ..... 89/36.13
2009/0120274 A1* 5/2009 Schneider et al. ..... 89/36.08

* cited by examiner

ARMED VEHICLE WITH IMPROVED STRUCTURE

This application claims benefit of Serial No. TO 2010 A 0001012, filed 17 Dec. 2010 in Italy and which application is incorporated herein by reference. To the extent appropriate, a claim of priority is made to the above disclosed application.

BACKGROUND

The present invention is relative to an armed vehicle, in particular it is relative to an armed vehicle with improved structure.

It is known that in the military field armed vehicles, both wheeled and tracked vehicles, are used, which are typically provided with a hull for housing the military personnel, on top of which there is at least one turret, which is provided with an arm, typically a howitzer or cannon, which can be associated to one or more machine guns.

Typically, the turret can rotate with a round angle, so as to be able to reach any firing direction, irrespective of the alignment of the vehicle with respect to a target to be hit.

Furthermore, the cannon or howitzer can be adjusted in its elevation angle, i.e. the angle existing between its carriage and the ground, so that it is possible to define not only the firing direction, but also the inclination of the latter, thus also varying the distance of the point in which a projectile will hit the target.

In particular, the cannon or howitzer of the turret of the armed vehicle fires ammunitions that typically comprise a first component, or projectile, and a second component, or propelling charge.

When in use, the projectile is the first one to be introduced into a breech of the carriage of the cannon or howitzer; subsequently, the propelling charge is introduced as well, following the projectile itself.

Traditional armed vehicles, in particular, present limitations connected to those maintenance operations during which the vehicle is partially disassembled, so as to allow access to its internal parts, in order to inspect them, service them or replace one or more pieces.

In particular, in case it is necessary to check parts that are close to or coinciding with the turret, the latter has to be disassembled with a significant waste of time.

Furthermore, traditional armed vehicles require a lot of time to be supplied with ammunitions; typically, the time deficit is particularly disadvantageous in those theaters of war in which efficiency and rapidity in ammunition rearmament, reloading and supply turn out to be essential for accomplishing a mission.

When considering the ammunition supply of the traditional type, it is necessary to keep in mind that this type of ammunition supply requires a double activity, since the armed vehicle has to be supplied with both projectiles and propelling charges, which are different from one another and are housed in magazines or loaders which, in turn, are distinct and arranged in different areas of the armed vehicle itself.

SUMMARY

Therefore, the object of the present invention is to describe an armed vehicle with improved structure, which does not present the drawbacks described above.

According to the present invention, an armed vehicle with improved structure is provided.

BRIEF DESCRIPTION OF THE DRAWINGS

The invention will now be described with reference to the accompanying drawings, which illustrate a non-limiting embodiment, wherein.

DETAILED DESCRIPTION

Figure 1:
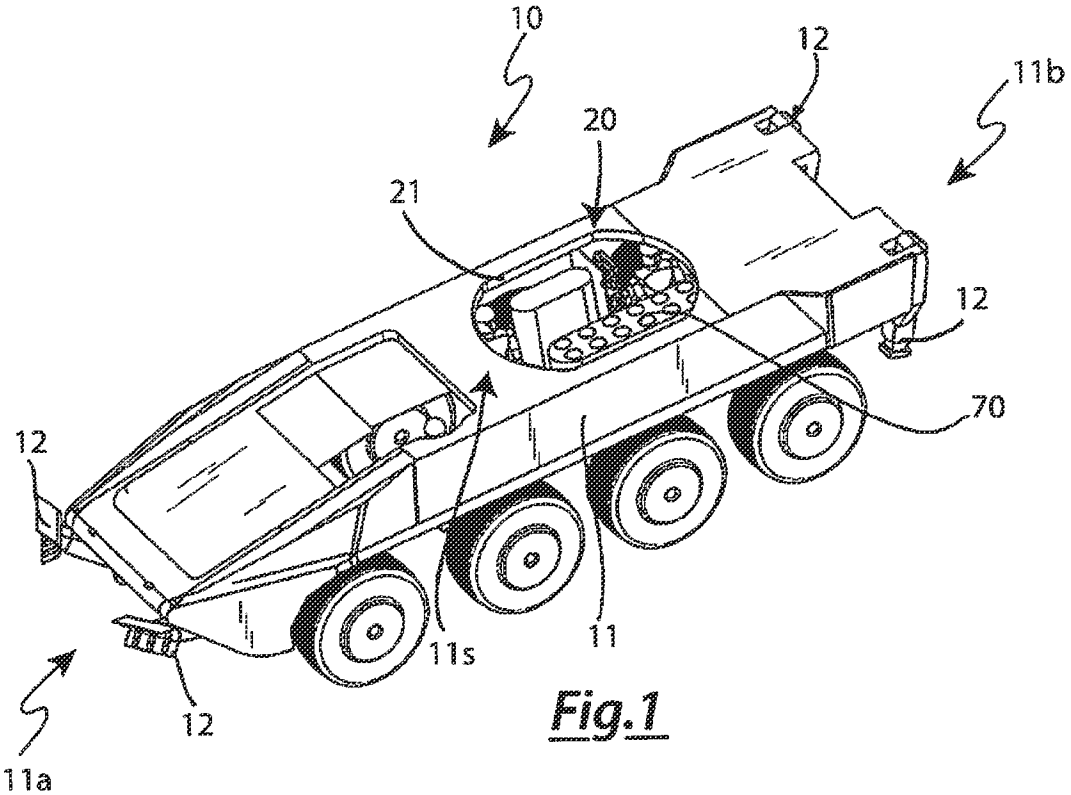
FIG. 1 illustrates a prospective view of part of an armed vehicle with improved structure according to the present invention.
Figure 2:
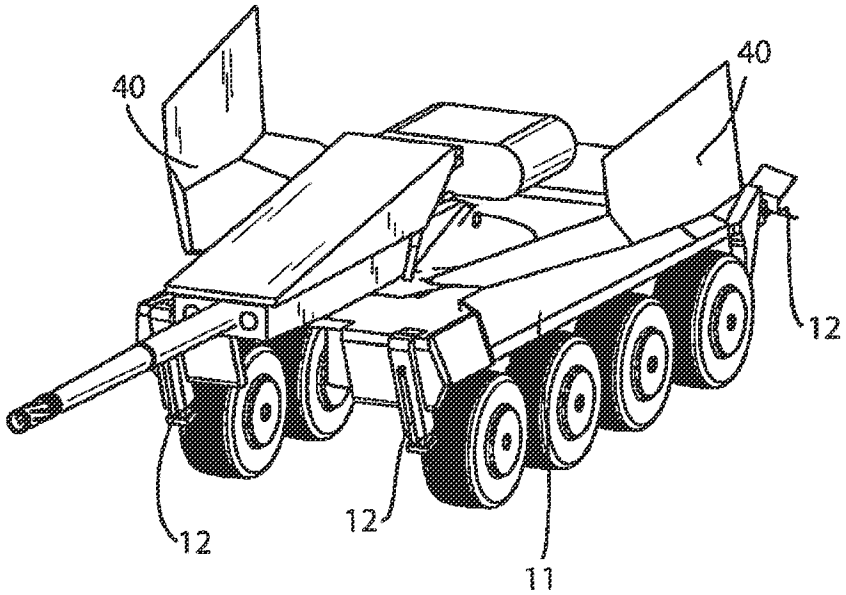
FIG. 2 illustrates a prospective view of part of the vehicle of FIG. 1.

With reference to FIG. 1, number 10 indicates an armed vehicle with improved structure as a whole.

Armed vehicle 10 comprises a hull 11, which is suited to house in its inside one or more men, who are at least in charge of driving armed vehicle 10 itself; the hull is moved by means of wheels, as shown in the figure, or by means of tracks, which are arranged on the left and on the right of the hull itself. Both the tracks and the wheels constitute comparable means for the movement on the ground.

Hull 11 presents a front part 11*a* and a rear part 11*b*, which is opposite to front part 11*a* and in correspondence to which a plurality of stabilization means 12 are arranged, close to respective corners.

Stabilization means 12 comprise a plurality of legs, which can be extended and arranged either in a first rest configuration, in which they do not interfere with the ground and are lifted and folded with respect to the ground, or in a second use position, in which, instead, they are extended and pressed against the ground, so as to guarantee a statically indeterminate stabilization of armed vehicle 10.

Hull 11 comprises a cold-added interface structural element 11*s*, which acts as interface with a turret.

Hull 11 presents, furthermore, an upper part, which is provided with a substantially circular hole 20, into which a rotatory turret 30 is inserted, which comprises at least one cannon, howitzer, or machine gun, if necessary a multiple one.

The turret, besides being rotatory, also allows an adjustment of the elevation angle of the cannon or howitzer, i.e. an adjustment of the angle existing between the ground and the carriage of the cannon or howitzer, so as to allow the latter to hit targets that are placed at different distances, regardless of the propelling charge.

The cannon or howitzer preferably fires, though in a non-limiting manner, ammunitions of the conventional type, which consist of a projectile and a propelling charge, which, in use, is inserted into the breech of the cannon or howitzer before the firing.

Hole 20 presents a rotation ring 21, which is installed on interface structural element 11*s* and is suited to guarantee a better rotation of turret 30.

Armed vehicle 10 comprises, furthermore, a plurality of external protection bodies 40, which are respectively arranged on the left and right side of the vehicle itself and can be configured either in a first open position or in a second closed position.

In the first open position, external protection bodies 40 allow an easy access to the armed vehicle and, in particular, to its inside, thus reducing the number of hours that are needed to carry out traditional maintenance/replacement/repair operations on elements comprised in armed vehicle 10.

In the second closed position, external protection bodies 40 are configured in such a way that they not only forbid access to essential components or accessories of vehicle 10, but also offer a higher protection to armed vehicle 10 itself.

Furthermore, armed vehicle 10 according to the present invention is provided with an ammunition loading opening 50, which is arranged on one of the two sides of the armed vehicle itself and, in detail, is arranged on one side of turret 30.

Said ammunition loading opening 50, which can be closed, presents a size that is slightly larger than the one of a projectile and, therefore, allows the semi-automatic supply of a reserve or loader present inside the armed vehicle.

Figure 4:
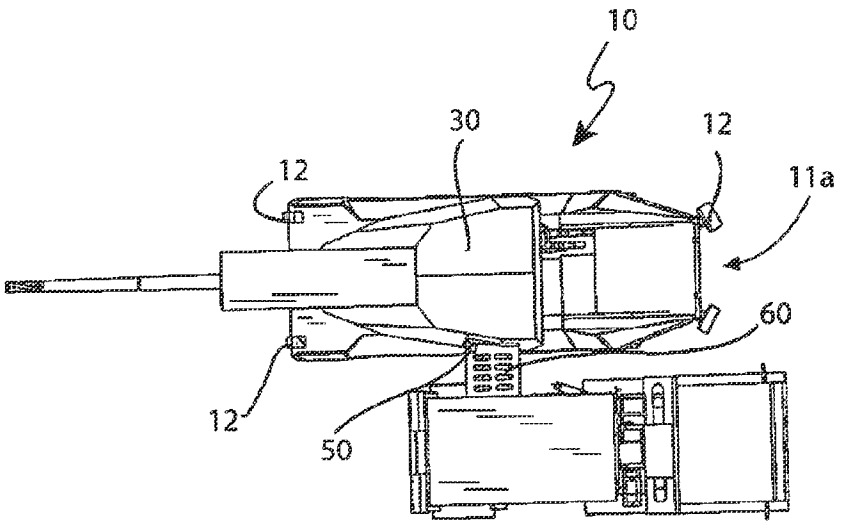
FIG. 4 illustrates a plan view of FIG. 3.
Figure 3:
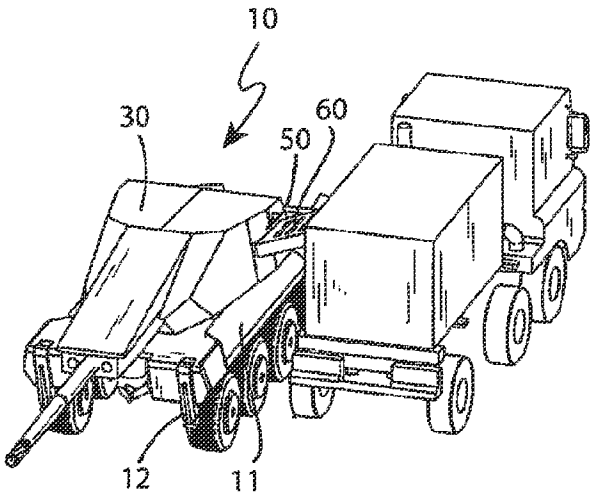
FIG. 3 illustrates a prospective view of the vehicle of FIG. 1, which, in this case, is side by side with an ammunition supply vehicle.
Figure 5:
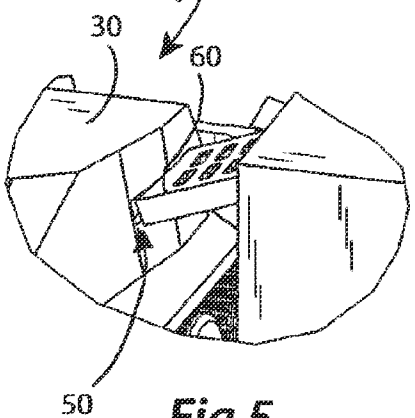
FIG. 5 illustrates a detail of FIG. 3.

As illustrated in FIG. 3, in FIG. 4 and, finally, in FIG. 5, armed vehicle 10 is first of all positioned side by side with an ammunition supply vehicle; subsequently, ammunition loading opening 50 is opened and coupled to a loading chute 60; then, the projectiles are translated by means of said loading chute 60 into turret 30.

At the end of the loading operation, ammunition loading opening 50 is closed again, thus allowing armed vehicle 10 to resume its activity.

Since the projectile magazine or loader of armed vehicle 10 is arranged in turret 30, the loading procedure becomes particularly fast and it does not need any longer a complete manual management, thus allowing the operator or the person in charge of the piece to stand in a much safer position and to work in a more efficient way in terms of time.

For example, the assembly consisting of ammunition loading opening 50 and loading chute 60 allows the user to complete the loading operation of twenty cannon projectiles in approximately five minutes.

Figure 6:
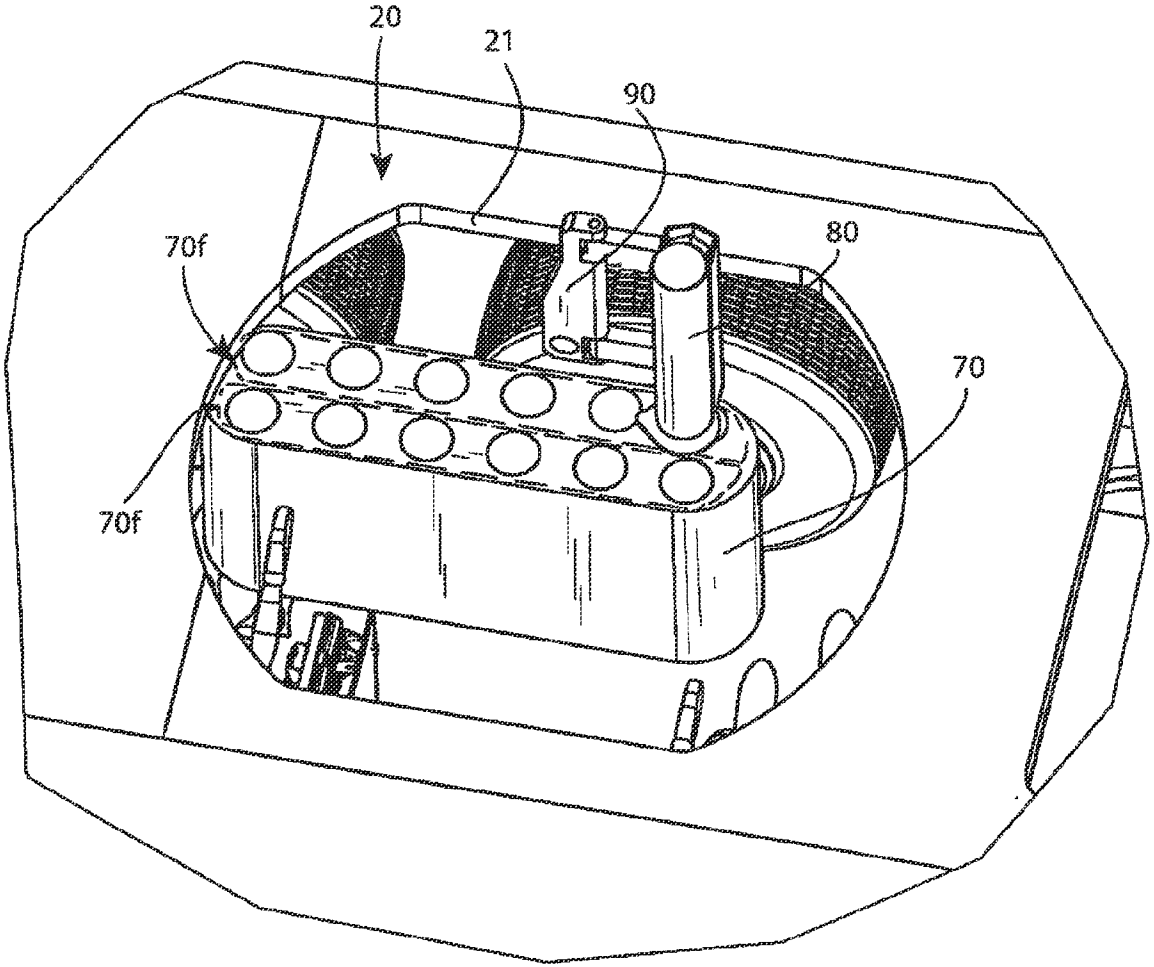
FIG. 6 illustrates a detail of FIG. 1.

As shown in FIG. 1 and, more in detail, in FIG. 6, armed vehicle 10 is also provided with a magazine or loader 70 for propelling charges 80. Loader 70 is operated in an automated manner by a main automated system, which is controlled by at least one data processing unit, which is designed to take care of the extraction of a propelling charge 80 from respective loader 70 after the insertion of a projectile of an ammunition into the breech on a cannon or howitzer mounted on the turret.

Obviously, loader 70 can be operated not only through an automatic loading procedure, but also through a manual redundancy command, which generates a secondary system for the manual emergency loading of ammunitions, which, therefore, is able to cause armed vehicle 10 to work even in case of failure of the main automated system.

In detail, loader 70 is mounted inside hull 20 in correspondence to substantially circular hole 20, so that above-mentioned propelling charges 80, which are preferably arranged in a vertical position with respect to the ground and are housed in a plurality of parallel rows of dead holes with a substantially circular shape, can be picked up by automatic propelling charge pick-up means 90, which are suited, through a command of the data processing unit, to pick up a propelling charge 80 from the magazine or loader 70 and bring it to the turret, so as to insert it at the end of a projectile, which has been previously inserted into the breech of the cannon or howitzer.

The advantages of the armed vehicle with improved structure according to the present invention are known in the light of the previous description. In particular, armed vehicle 10 according to the present invention allows propelling charges to be loaded in a substantially automatic manner, thus remarkably reducing the activity of the loading personnel; as a consequence, loading operations are faster and less subject to possible mistakes and, in this way, the inactivity time of the vehicle, which is particularly dangerous and inefficient in the theaters of war, is reduced.

Furthermore, the armed vehicle according to the present invention, thanks to the cold-added interface, allows an easier coupling with turret 30.

Cold-added interface structural element 11*s* can be used on different types of vehicles with standard changes that have to be carried out to adjust it to the specific case.

The possibility to partially open the armed vehicle in case of maintenance or replacement operations, once again, plays an advantage role in terms of time needed to resume the full activity of the armed vehicle, though without a reduction of the intrinsic safety of the personnel inside the hull.

The invention claimed is:

1. Armed vehicle, comprising:

a hull configured to house at least one man when in use, said hull including a front part, a rear part and at least four corners, said hull extending from a front to rear and side to side of said vehicle, said hull defining a vehicle cockpit to facilitate driving the vehicle;

a plurality of wheels for terrestrial maneuvering;

a turret armed with a howitzer and positioned upon an upper part of said hull;

an interface structural element; said interface structural element making an interface between said hull and said armed turret;

the hull including an opening positioned at the upper part of the hull, the opening connecting the hull to the turret; the hull comprising a plurality of stabilizers arranged proximate four of the corners of the hull;

an ammunition loading aperture positioned on said armed turret; said ammunition loading aperture being configurable between a first open configuration and a second closed configuration;

wherein in use in said first open configuration, said ammunition loading aperture is coupled to an ammunition loading chute and ammunition are translated by said loading chute into said turret;

a storage and a pick-up device for a plurality of propelling charges of ammunition for said howitzer; said storage and said pick-up device being positioned inside said hull and corresponding to said opening positioned at the upper part of said hull.

2. The armed vehicle according to claim 1, wherein said dead holes comprise holes of substantially cylindrical shape, arranged on a plurality of parallel rows and housing said propelling charges in a direction of maximum extension substantially orthogonal with respect to the ground.

3. The armed vehicle according to claim 1, further comprising a plurality of external protection objects configured alternatively in a configuration between a first open configuration and a second closed configuration and wherein, in said first open configuration, said external protection objects permit a separated access of the armed vehicle for carrying out a component maintenance, replacement or repairing operation.

4. The armed vehicle according to claim 1, wherein the stabilizers comprise extendible legs.

5. The armed vehicle according to claim 1, wherein said opening comprises a rotation ring, installed upon said interface structural element.

* * * * *